United States Patent [19]

Hellstrom

[11] 4,298,172

[45] Nov. 3, 1981

[54] METHOD AND APPARATUS FOR CONTROLLING A THREAD STORAGE AND FEEDER DEVICE

[75] Inventor: Jerker Hellstrom, Nol, Sweden

[73] Assignees: Aktiebolaget IRO, Ulriceham; Aros Electronics AB, Askim, both of Sweden

[21] Appl. No.: 169,991

[22] Filed: Jul. 18, 1980

Related U.S. Application Data

[63] Continuation of Ser. No. 960,624, Nov. 14, 1978, abandoned.

[30] Foreign Application Priority Data

Nov. 14, 1977 [SE] Sweden ..... 7712808

[51] Int. Cl.[3] ..... B65H 51/20

[52] U.S. Cl. ..... 242/47.01; 139/452

[58] Field of Search ..... 242/47.01, 47.04, 47.05, 242/47.06, 47.07, 47.08, 47.09, 47.1, 47.11, 47.12, 47.13; 66/132 R; 139/452

[56] References Cited

U.S. PATENT DOCUMENTS

| | | | |
|---|---|---|---|
| 3,276,484 | 10/1966 | Bucher | 139/452 |
| 3,575,216 | 4/1971 | Strauss | 139/452 X |
| 3,674,057 | 7/1972 | Hosono et al. | 139/452 |
| 3,796,386 | 3/1974 | Tannert | 242/47.01 X |
| 3,904,141 | 9/1975 | Rosen | 242/47.12 |
| 4,132,368 | 1/1979 | Schiess et al. | 242/47.01 |
| 4,226,379 | 10/1980 | Brouwer et al. | 242/47.01 |

FOREIGN PATENT DOCUMENTS 1809091 6/1970 Fed. Rep. of Germany .

*Primary Examiner*—Stanley N. Gilreath
*Attorney, Agent, or Firm*—James E. Nilles

[57] ABSTRACT

The present invention provides a method and apparatus which enables thread to be wound onto the motor driven storage drum of a thread storage and feeding device for a thread processing machine strictly continuously and uniformly with the aim of ensuring that the thread as wound off the thread supply bobbin is wound onto the storage drum in such a way that variations in the tension of the thread as pulled off the storage drum are eliminated. This is achieved by controlling the number of revolutions of the motor in response to a control signal which is derived from the thread intermediate supply on the drum and the actual thread consumption, i.e., the average speed of the thread leaving the drum.

13 Claims, 8 Drawing Figures

R S T
1
3
4
3'
38
2
6
34
7
8
5
SIGNAL GEN.
12
11
13
SHAPING CIRCUIT
14
15
INTE-GRATOR
16
19
PULSE GEN.
20
21
17
SUMMING MEMBER
18
18A
COMPARATOR
C18
27A
DRIVE CIRCUIT
27

V
n
l

P
0 max.
0 t
t1
t2
t3
t4
t5
t6
t7
t8
t9
t10
t11

METHOD AND APPARATUS FOR CONTROLLING A THREAD STORAGE AND FEEDER DEVICE

REFERENCE TO RELATED CO-PENDING APPLICATION

This application is a continuation application from my co-pending U.S. patent application Ser. No. 960,624, filed Nov. 14, 1978, now abandoned. This continuation application claims priority of the Swedish application Ser. No. 77-12808-0 filed Nov. 14, 1977.

FIELD OF INVENTION

The present invention relates to a method and an apparatus for controlling a thread storage and feeder device for thread processing machines, wherein the amount of thread supply on a thread drum serving as an intermediate storage is detected and a signal is produced to control the rotation of speed of a motor winding-up the thread on the thread drum.

BACKGROUND OF PRIOR ART

Textile machines, such as weaving machines, knitting machines or the like are fed with yarn, or more generally expressed with thread, from so-called supply bobbins. Certain machines of this type, e.g. most of the modern weaving machines, do not consume the thread at a constant speed, but the thread is drawn intermittently, i.e., by jerks, when the so-called "pick" goes into the machine. "Pick" means the intermittent insertion of the thread, e.g. by means of an air and/or water jet or by means of a mechanical thread guide member.

This intermittent winding off of the thread from the supply bobbin often leads to difficulties in achieving a sufficiently constant and low thread tension, among others due to unfavorable geometry and location of the supply bobbin and also due to the fact that the winding off forces vary as the size of the bobbin decreases when the thread is unwound, that can easily result in thread breakage followed by a standstill of the textile machine. To eliminate these drawbacks and to supply the machine with a constantly checked quantity of thread, a so-called thread feeder or according to the technical terminolgy a "storage feeder" is placed between the supply bobbin and the machine, preferably as close to the thread input of the machine as possible.

In such thread feeders or storage devices, a winding-on-member driven by an electric motor is usually used to wind up the thread onto a stationary storage drum. The thread wraps round on this drum, establishing the desired thread supply, from which the machine pulls off the amount of thread momentarily required.

In order to adapt the speed at which thread is wound onto the drum to the wind-off speed, it is common to control the thread supply on the drum to try to keep this thread supply within certain limits. DE-OS No. 18 09 091 describes a feeding device, which includes an optical sensing device providing for an increase or decrease of the driving motor in case that the thread supply reaches a lower range a or an upper range b, respectively. In a middle range c lying between these two ranges a and b, the driving motor is controlled by a constant control signal, which leads to a certain unvariable speed at which the thread is wound onto the drum. The amount of yarn on the drum within this range c therefore either tends to leave for range a or range b, since in all practical conditions, the take-off speed will never be exactly the same as the speed at which thread is wound onto the drum. If, for example, thread is taken off at a speed which is higher than the speed at which thread is wound onto the drum, the thread supply will leave range c for range a. As soon as the supply reaches range a, the motor speed will be increased and the thread storage will be filled up again. Due to inertia of the system, the thread supply will be filled up to some point within range c and then diminish again. Such variations in the amount of thread supply on the drum and wind-on speeds, however, lead to tension variations in the offgoing thread, which may cause quality variarions in the textile product manufactured on the machine to which such a storage feeder is connected.

The object underlying the present invention is to overcome the above disadvantages and to provide for a method and an apparatus for controlling a thread storage and feeder device, which automatically adapts its winding-on speed to the actual thread consumption.

In a method of the type described above, this object is achieved by generating a control signal for the number of revolutions of the motor which depends both on the amount of the thread supply and the actual thread consumption.

In contrast to the methods used up to now, the method according to the present invention takes into consideration the speed with which the thread is taken off from the storage drum. This results in a method of driving the motor, which is substantially improved compared with known methods, since the consideration of the actual thread consumption during the regulation of the number of revolutions of the motor effects that the number of revolutions is in good correspondence to the thread consumption, so that the thread is wound up continuously. The present invention allows that the thread supply on the intermediate storage is held small, so that the invention meets the above-mentioned requirement to a great extent.

In a preferred embodiment of the present invention, it is provided that the motor is driven with a maximum and a minimum rotational speed if the amount of thread on the thread drum is within a lower range a or an upper range b, and that the rotational speed of the motor is controlled by a control signal derived from the actual thread consumption when the thread supply is within lower limit a so that the thread supply is quickly replenished. On the other hand, the motor speed is sharply decreased or even stopped, if the storage drum is full. Since the thread consumption is taken into account in the regulation, the motor is driven with a rotational speed which corresponds to the thread consumption, when the thread supply lies between said two limits. In the stationary state, the rotational speed of the motor substantially correspond to the thread consumption, i.e., the speed with which the thread is pulled off from the storage drum. In this stage, disadvantageous variations of the thread tension are practically completely eliminated.

In an apparatus for controlling the rotational speed of a winding member of a thread storage and feeding device for thread processing machines which includes a thread drum for momentarily storing thread from a supply bobbin in the form of a thread supply, comprising an electric motor for driving said winding member, sensing means responsive to the amount of said thread supply momentarily present on said thread drum and a signal processing means connected between the sensing means and the electric motor, which in a lower range a, an upper range b and a middle range c, provides for different output signals controlling the rotational speed of the motor, the present invention provides that the signal processing means includes a signal correction means which stores the value of the output signal used in range c before this range has been left for range a or range b and that the signal processing means corrects the value stored in the correction means when the yarn supply is either in range a or range b.

The apparatus according to the invention automatically adapts its winding-on speed to the actual thread consumption by stepwise correction of the control signal for the motor. If the apparatus should have a tendency to leave middle range c for the upper range b, this occurrence is used every time as a criteria that the rotational speed of the motor is still too large and it is decreased stp-by-step until this rotational speed is exactly adapted to the actual thread consumption. The step width may be proportional to or a function of the time periods during which the thread supply stays within either lower range a or upper range b.

BRIEF DESCRIPTION OF THE DRAWINGS

The invention will be described in more detail in the following specification with reference to the attached drawings, in which

FIG. 1 shows a schematic diagram of a thread feeder 1, known per se, including an electric motor 2. A thread 38 is wound onto the storage drum 3 by means of a winding-on member 3' driven by motor 2, the thread 38 travelling through the hollow axis of the assembly. In correspondence to the thread consumption, the thread is then pulled over the winding-on member 3' axially from the drum and is fed to an associated thread processing machine. A ring 4 disposed on the thread drum 3 senses the amount of the thread supply 34 and actuates an indicating element 6 by means of a rod 5.

Figure 1:
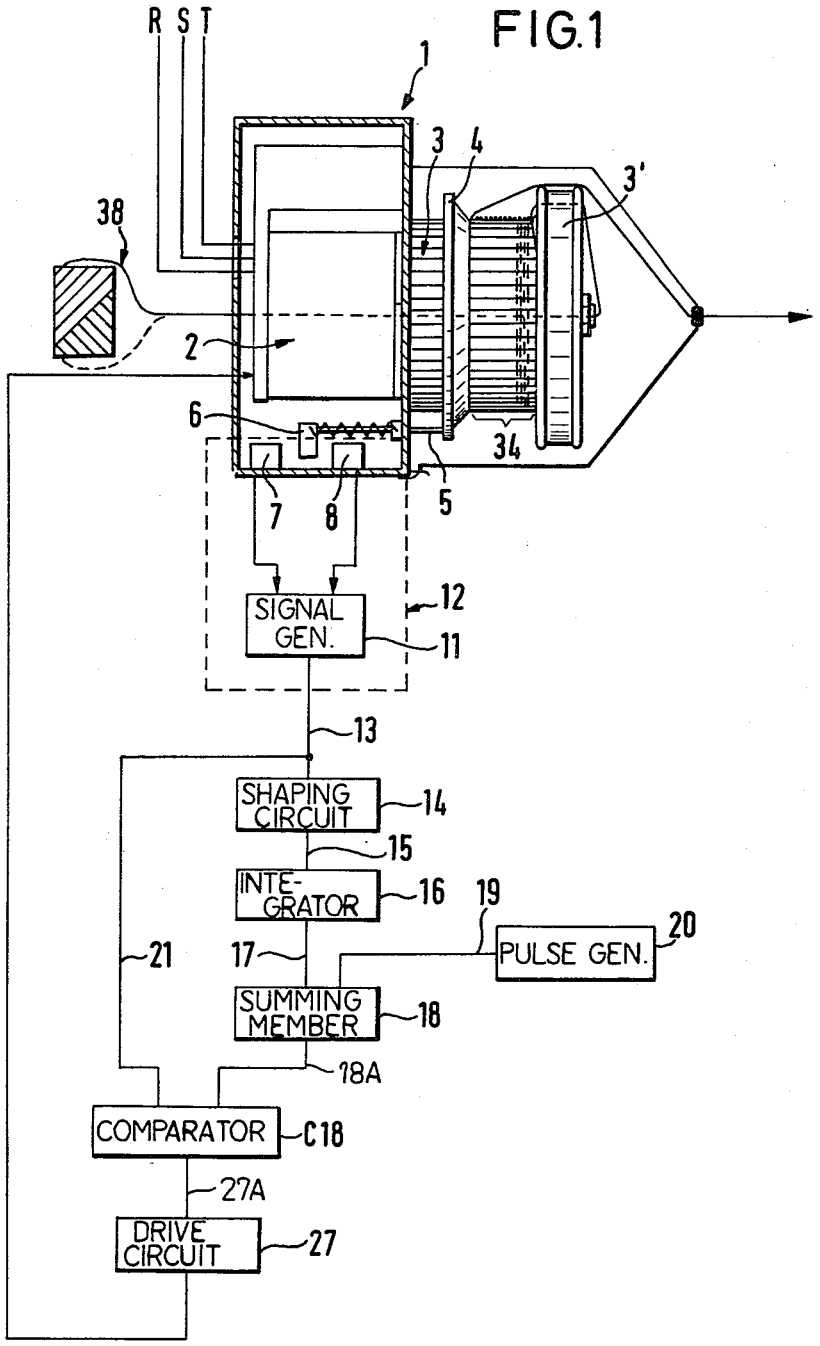
FIG. 1 shows a block diagram of a preferred embodiment of the present invention.

Sensing elements 7 and 8 are provided. In the embodiment described herein, the elements 7 and 8 include light emitting diodes 9 which send light to phototransistors 10 disposed in the vicinity of the diodes. If the indicating element 6 comes between one diode 9 and one phototransistor 10, an output signal is generated indicating the position of the indicating element 6. The output signals of the sensing elements 7 and 8 are applied to a signal generator 11, which is responsive to the position of the indicating element 6 and produces one of three voltage levels, and each of these three voltage levels indicates whether the thread supply 34 momentarily is within a lower range a, an upper range b, or a middle range c.

The output signal of the signal generator 11 is applied to a forming or shaping circuitry 14 over a lead 13. The output of the forming circuit 14 is connected to an input of an integrator 16 over a lead 15. The output of the integrator 16 is applied to a summing member 18 over a lead 17. A second input of said summing member 18 receives the output signal of a pulse generator 20, which generates pulses of triangular shape, over a lead 19. In this embodiment, the triangular pulse generator comprises a saw-tooth generator 20.

The connection or lead 13 branches and is connected to the first input of a comparator C18 over a lead 21. The second input of the comparator C18 is connected to the output of the summing member 18 by a lead 18A. The output of comparator C18 is connected to a drive circuit 27 over a lead 27A. The output signals of the drive circuit 27 control the voltage applied to the motor, i.e., the output signals of the drive circuit 27 control the number of revolutions of the motor.

Before giving a detailed explanation of the operation of the diagram shown in FIG. 1, a detailed circuit diagram of this arrangement will be described making reference to FIG. 2. On the top of FIG. 2, the components of the two sensing elements 7 and 8 are depicted. A light emitting diode 9 and a phototransistor 10 are provided for each sensing element 7,8. It is to be understood that said elements are arranged such that the light which is emitted by the diodes 9 reaches a corresponding transistor 10 to turn it on. The element 6 constitutes a light barrier. Signal generator 11 produces an output signal having one of three possible levels which are responsive to whether one of the light emitting diodes 9, is covered by the indicating element 6, or to the fact that none of the light emitting diodes 9 is covered. The details of the sensing device are clear from the drawing and therefore a detailed description is omitted, since only the output signal produced is important for the understanding of the circuitry according to the present invention.

The forming circuit 14 comprises a diode **14*a*, the cathode thereof being connected to the output lead 13 of circuit 11. In parallel to diode 14*a*, there is connected a circuit comprising a diode 14*b* and a condensor 14*d* connected in series. Between these two elements, a series circuit comprising a diode 14*c* and a resistor 14*e*** is connected.

The output signal of the forming circuit 14 is applied to the integrator 16. The integrator comprises an input resistor **16*a*, an operational amplifier OP16 and an integrating capacitor 16*b*** connecting one input and the output of the operational amplifier.

Figure 2:
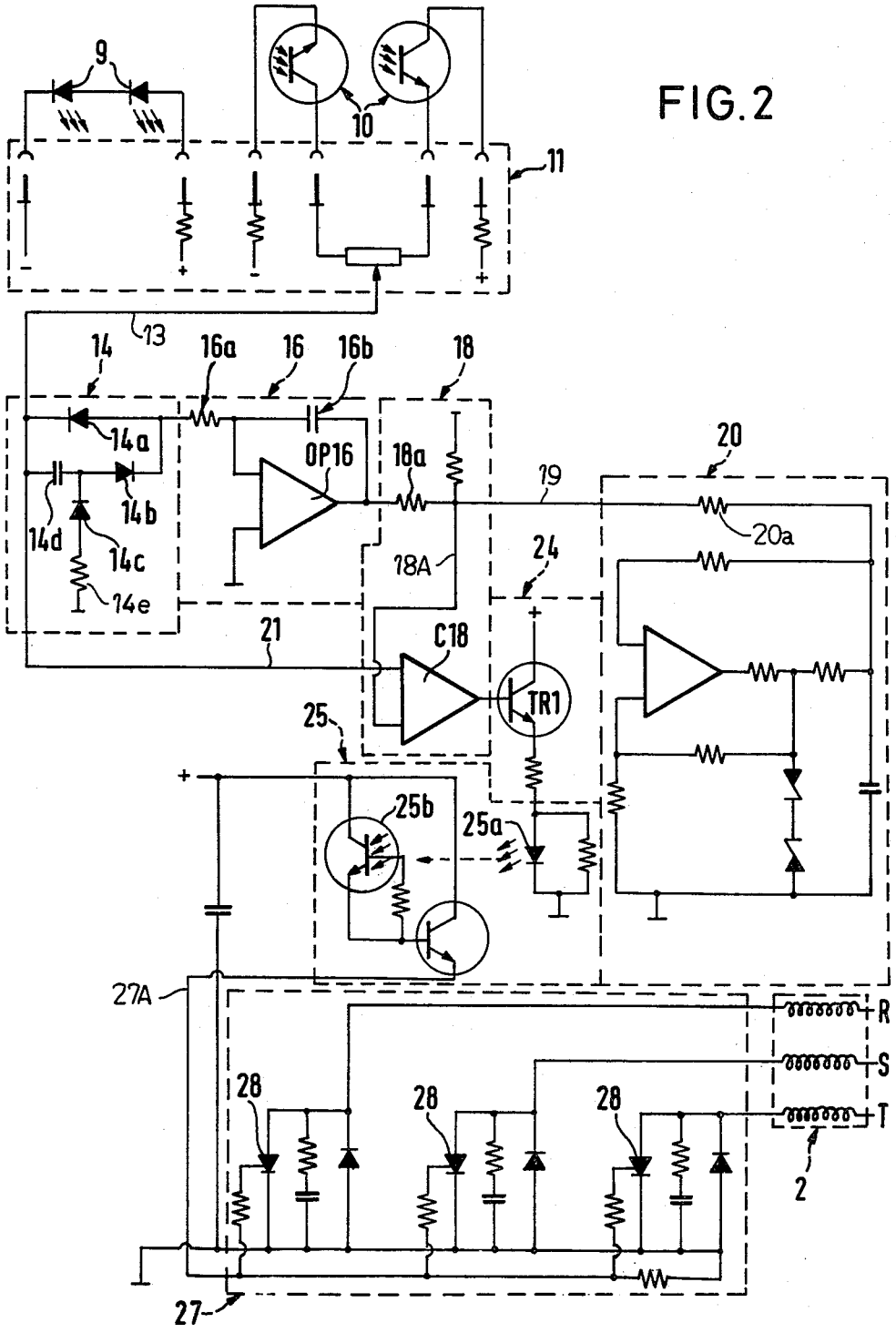
FIG. 2 shows a detailed circuit diagram corresponding to the block diagram shown in FIG. 1, FIGS. *3a–3t* show pulse diagrams illustrating the operation of the circuitry as shown in FIG. 2.

On the right hand side of FIG. 2, the saw-tooth pulse generator 20 is depicted. The saw-tooth generator provides output pulses of saw-tooth shape having a frequency of 10 Hz, the voltage of the saw-tooth oscillating between +5 and −5 volts. Saw-tooth generators and triangular pulse generators of this type are known per se, and a detailed description is omitted, since the design and functioning of such circuitries is obvious for those skilled in the art. The output signal of the saw-tooth generator 20 is applied to a resistor **20*a* and then to one terminal of a resistor 18*a*. The other terminal of resistor 18*a* is connected to the output of the operational amplifier OP16. The resistor 18*a* is connected with one input of a comparator or differential amplifier C18 by lead 18A. The other input of the comparator C18 receives the output signal of circuit 11 through lead 21**.

The output of the comparator C18 is connected to the base of a transistor TR1 of a drive circuit 24. The output of the comparator C18 assumes either a high or low level, depending on the characteristics of the two input signals.

The output of the drive circuit 24 is connected to an opto-electronic coupling means 25. The optoelectronic coupling means comprises a light emitting diode **25*a* and a phototransistor 25*b* disposed in the vicinity of the diode 25*a*. This galvanically decoupling effects that interferences of the electronic controlling circuitry are substantially eliminated. The output of the optocoupler is connected to a drive circuit 27 comprising three thyristors 28. Each of the thyristors drives one phase R, S, T of the electromotor 2 of the thread feeder 1. As it is now clear to those skilled in the art, the thyristors 28 are activated in response to the conducting time of transistor TR1**, so that a high or low revolution number of the motor is achieved.

Figures 3A, 3B, 3C, 3D, 3E, 3F:
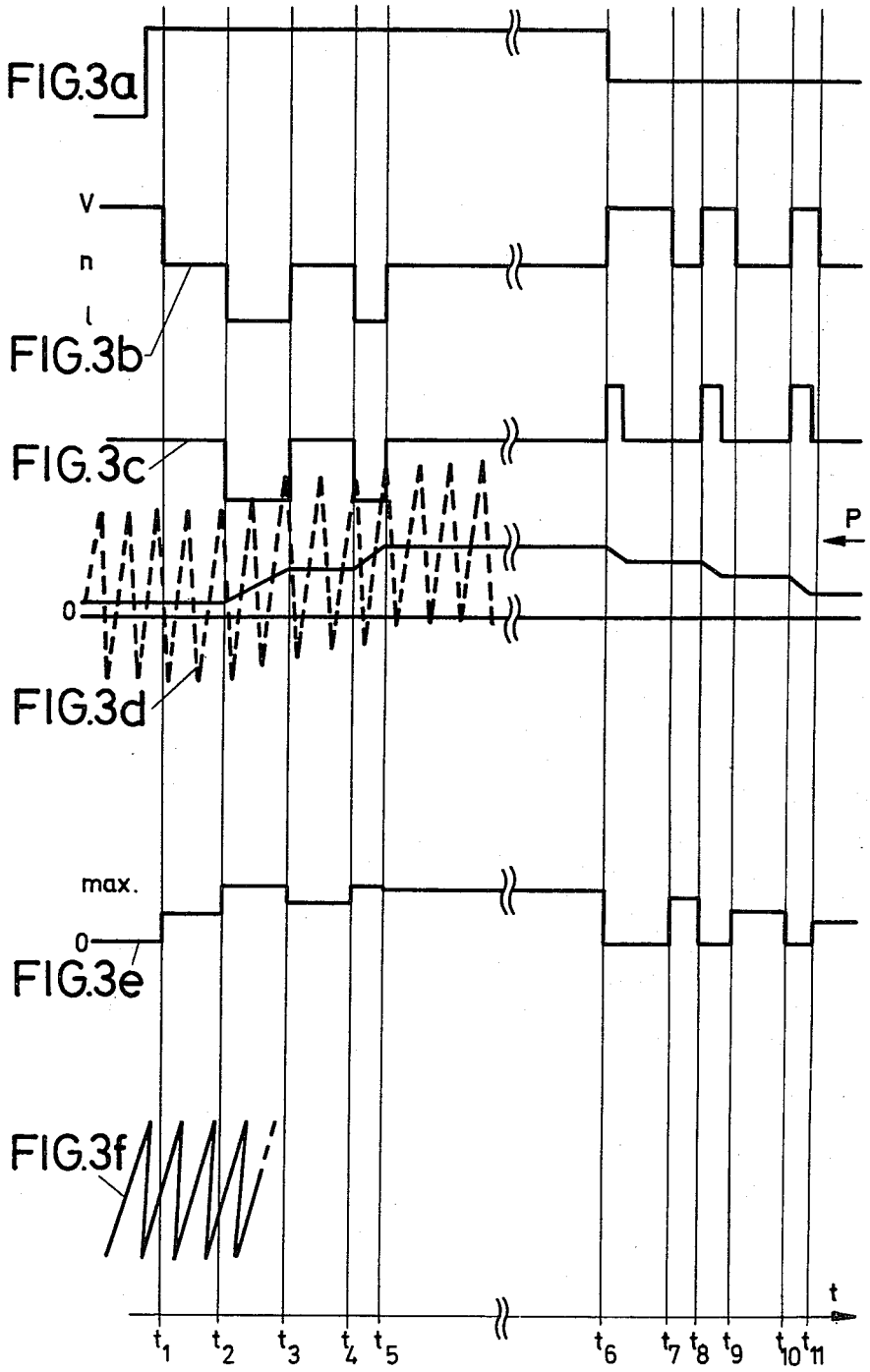

In the following, the operation of the circuitry described above will be explained making reference to FIG. 3. FIG. 3 shows the characteristics of the different signals at different times. The time axis is shown at the bottom of FIG. 3 and interesting points are marked with reference numerals $t_1$ to $t_{11}$. The interval from $t_5$ to $t_6$ is shown shortened and it should be understood that this interval in normal operation may be very long. FIG. 3*a* illustrates the average speed with which the thread is pulled off from the intermediate storage by the textile machine, i.e. the actual thread consumption. Due to an increase of thread consumption prior to the time $t_1$, the thread supply on the drum decreases, so that the indicating element 6 no longer covers the light emitting diode 9 which indicates that the supply is in upper range b. In response thereto, the signal at the output of circuit 11 drops from a high level V to an intermediate level n, e.g. 0 volt. At time $t_2$, the lower range b of the storage supply is reached, so that the signal at the output of circuit 11 assumes a negative level 1, as can be seen in FIG. 3*b*.

The forming circuit 14 generates a negative signal at the time $t_2$, and this negative signal is fed to the integrator 16. The circuit is designed such that the output signal of the integrator 16 increases when a negative voltage is applied to the input. From the shape of pulse train (FIG. 3*c*), it can be seen that the circuit 14 generates a pulse of predetermined width each time the output voltage of the circuit 11 changes in order to assume a positive level as it is depicted at the times $t_6$, $t_8$, and $t_{10}$. The increase of the output voltage of the integrator 16 can be adjusted by corresponding dimensioning of the integrator 16 or the forming circuitry 14. A comparison of the signals in FIG. 3*c* and FIG. 3*d* shows that the output voltage of the integrator 16 is maintained constant when the signal of FIG. 3*c* assumes an intermediate level, e.g. 0 volt. When the pulses of the signal in FIG. 3*c* are positive, the output voltage of the integrator 16 decreases.

The advantage of circuit 14 producing positive pulses of predetermined width becomes clear if one considers the situation in which the thread 38 is broken on the downstream side of the feeder 1. A broken thread causes the textile machine to stop and the thread supply on the drum 3 will be filled up, so that signal FIG. 3*b* would be applied to the integrator 16, the output voltage thereof would drop to zero. After resumption of the machine operation (with the same thread consumption as previously) the output signal of the integrator 16 would have too small an amplitude not corresponding to the actual thread consumption. Circuit 14 ensures that the output of the integrator 16 is substantially maintained during the time in which the machine is stopped.

The output signal of the saw-tooth generator 20 is schematically depicted in FIG. 3*f*. Signals FIG. 3*d* and FIG. 3*f* are summed up in the summing member 18, so that a summing signal is generated. This signal is applied over lead 18A to the lower input of the comparator C18. The other input of the comparator C18 receives a reference signal over the lead 21. When the signal on lead 21 assumes a zero level, the output of comparator C18 will assume a positive level, if the other input of the comparator C18 receives a higher voltage than the reference input, i.e., if the other input receives a voltage greater than zero. The summing signal is therefore continuously compared with the reference signal on the lead 21. The circuitry therefore constitutes a pulse-width control circuit. If the reference signal, for example has a level which is indicated by an arrow P in FIG. 3*d*, the comparator C18 generates an output signal each time when the summing signal exceeds this reference level. From the shape of the summing signals, it can easily be seen that the output signal of the comparator C18 assumes longer a high level the higher the output voltage of the integrator is, since in such a case the saw-tooth signal is elevated correspondingly, so that the reference level is exceeded longer. The resulting control voltage is schematically depicted in line FIG. 3*e*. As can be seen from FIG. 3*e*, the effective motor voltage is high, when the output signal of the integrator 16 is high.

If the thread supply reaches the lower range a, a negative pulse is produced on lead 21. This ensures that the other input of the comparator C18 is forced to a relatively higher level, so that during the whole time of the negative pulse on lead 21, the comparator C18 generates a high output signal, in order to drive the motor 2 with the greatest possible number of revolutions. This effects that the thread supply is quickly filled up when the lower range a of the supply is reached. On the other hand, a positive signal on lead 21 generates a positive reference signal, if the thread supply is in the upper range b. The positive reference signal has the effect that the other input of the comparator C18 which receives the summing signal is forced to be lower than the reference signal so that the output of the comparator produces a low level voltage. Consequently, the number of revolutions of the motor 2 is switched to a minimum value. The lower value may cause a complete stop of the motor in order to prevent still more thread from being wound up onto the drum.

In those time ranges in which the thread supply is either in the lower range a ($t_2$–$t_3$; $t_4$–$t_5$ in FIG. 3) or the upper range b ($t_6$–$t_7$; $t_8$–$t_9$; $t_{10}$–$t_{11}$ in FIG. 3), the motor 2 is controlled by a selected maximum or minimum voltage (cf. FIG. 3*e*). In the time ranges, in which the thread supply is in the middle range c ($t_1$–$t_2$; $t_3$–$t_4$; $t_5$–$t_6$; $t_7$–$t_8$; $t_9$–$t_{10}$ in FIG. 3), the motor 2 is controlled by the output signal of comparator C18, which in this time range is practically the inverted signal of integrator 16. This output signal is not constant but it is varied by the actual thread consumption. As can be seen best from FIG. 3*b*, the output signal of the integrator 16 is increased in those time periods, in which the thread supply is in lower range a and decreased in the time periods, in which it is in upper range b. The resulting output signal of integrator 16 is used to control the motor in the subsequent time period, in which the thread supply is in the middle range c. Whereas the amount of increase in the output signal of integrator 16 depends on the durations of the time periods, in which the thread supply is in the lower range a, its decrease during the time periods, in which the thread supply is in the upper range b is constant, due to the function of the pulseformer 14. It is advisable to use constant small pulses in the upper range b only if the time durations during which the thread supply is in this range b exceed a certain limit and provide for even shorter pulses for extremely short time durations, or even to delete the output pulse of pulse former at all, if the thread supply is in upper range b only for a very short time. This difference has been made to ensure that the thread supply in lower range a is filled up as quickly as possible to avoid that the supply runs empty. In case of the upper range b, it is not so important to reduce the amount of yarn in a quick action. By amending the integrator signal only be constant small steps independent of the time durations, in which the supply stays in the upper range b, the control operates softer.

The essential part of the circuit shown in FIGS. 1 and 2 is the integrator 16 which works as a signal correction means adapting its output signal to a value that the motor 2 is controlled in range c with a rotational speed resulting in an adaptation of the speed at which the thread is wound onto the drum 3 to the actual thread consumption. If the thread supply by starting the operation, or after an amendment of the value of thread consumption, should have a tendency to increase, it reaches, after a certain time, the upper range b. As far as the thread supply has reached this upper range b, the rotational speed of motor 2 is decreased to its minimum value, until the thread supply has gone back to middle range c. During this time period, the value of the output signal stored in integrator 16 is decreased by a predetermined step and the motor 2 is controlled now by this newly corrected value. Should the rotational speed of motor 2 still be too large, upper range b is again reached, the motor 2 is again controlled with its minimum control signal, until middle range c is again reached and a further decreased value of output signal of the integrator 16 is used until a complete adaptation of the rotational speed of motor 2 to the actual thread consumption is established. A similar correction of the output signal of the integrator 16 is carried out, if the thread supply should have a tendency to go to the lower range a.

The saw-tooth generator 20 is only used to simplify the overall circuit design. This saw-tooth generator, the output signal of which is added to the output signal of the integrator 16 in summing device 18, provides for an output signal at comparator C18 in the form of pulses with constant amplitude but with a ratio between pulse times and non-pulse times, which is proportional to the difference between the output signal of integrator 16 and the second input signal of comparator C18. The amplitude of the output signal of saw-tooth generator 11 has a middle or zero value. In lower range a and upper range b, in which this output signal has a minimum or maximum value, the output signal of signal generator 20 is ineffective and comparator C18 provides for a maximum or minimum value, respectively (cf. FIG. 3*e*).

I claim:

1. A method for controlling the rotational speed of a winding member of a thread storage and feeding device for a thread processing machine which includes a thread storage drum for intermediate storage of thread from a supply bobbin and an electric motor for rotating said winding member, comprising the steps of: detecting the amount of the thread supply on said thread drum and providing an electric signal related thereto; providing an electric signal representative of the average rate of consumption of thread from said drum; combining both of said electric signals to provide an electric control signal; and using said control signal to control the rotational speed of said motor.

2. A method according to claim 1 including the steps of controlling rotation of said motor at a maximum and a minimum number of revolutions, if the amount of thread supply on the thread drum is at a minimum limit and a maximum limit, respectively, by means of said control signal and controlling rotation of said motor by said signal related to average thread consumption when said thread supply on said drum is between said limits.

3. A method according to claim 1 including the step of deriving the signal representative of average thread consumption from the time interval during which the thread supply on said drum corresponds to at least one predetermined value.

4. A method according to claim 3 wherein said predetermined value corresponds to one of said minimum or maximum thread supply limits.

5. A method according to claim 1 wherein said signal related to the amount of thread supply is fed to an integrator prior to being combined with the other of said electric signals.

6. A method according to claim 5 wherein said electric signal representative of average thread consumption takes the form of a train of pulses of triangular shape and including the steps of adding said pulses to the output signal of said integrator to provide a summing signal, applying the latter signal to a threshold circuit, and utilizing the output signal of said threshold circuit for activating a drive circuit for said motor.

7. Apparatus for controlling the rotational speed of a winding member of a thread storage and feeding device for thread processing machines which includes a thread drum for momentarily storing thread from a supply bobbin in the form of a thread supply, comprising an electric motor for driving said winding member, sensing means responsive to the amount of said thread supply momentarily present on said thread drum and a signal processing means connected between the sensing means and the electric motor, which in a lower range a, an upper range b and a middle range c, provides for different output signals controlling the rotational speed of the motor, characterized in that the signal processing means (14, 16, 18, C18, 20) includes a signal correction means (16) which stores the value of the output signal used in range c before this range has been left for range a or range b and that the signal processing means corrects the value stored in the correction means when the yarn supply is either in range a or range b.

8. Apparatus according to claim 7 characterized in that the value of the signal for controlling the speed of the electric motor in a range c is varied in accordance with the time periods during which the amount of thread supply stays in range a or range b, respectively.

9. Apparatus according to claim 7, characterized in that the signal correction means includes a pulse former (14) which clips the time periods in which the yarn supply is in range b.

10. Apparatus according to claim 7, characterized in that the signal correction means is an integrator (16).

11. Apparatus according to claim 7, characterized in that the signal processing means (14, 16, 18 C18, 20) includes a saw-tooth generator (20) whose saw-tooth signal is added in a summing member (18) to the signal from said integrator, in that the sum signal is subtracted in a comparator (C18) from the output signal of said sensing means.

12. Apparatus according to claim 11, characterized in that the frequency of the saw-tooth signal is between 5 Hz and 25 Hz.

13. Apparatus according to claim 7, characterized in that the sensing means (6, 7, 8, 11) includes a sensor (8) for range a and a further sensor (7) for range b.

* * * * *